United States Patent [19]

Maestri

[11] 4,183,505

[45] Jan. 15, 1980

[54] GUARD BARRIER SYSTEM

[76] Inventor: Frederick A. Maestri, 66 Forbell Dr., Norwalk, Conn. 06850

[21] Appl. No.: 943,766

[22] Filed: Sep. 20, 1978

[51] Int. Cl.[2] ..... E01F 15/00

[52] U.S. Cl. ..... 256/13.1; 256/19; 114/220; 404/10

[58] Field of Search ..... 256/1, 13.1, 19; 404/6, 404/9, 10; 114/220

[56] References Cited

U.S. PATENT DOCUMENTS

| | | | |
|---|---|---|---|
| 1,795,247 | 3/1931 | Burns | 256/13.1 |
| 3,292,909 | 12/1966 | Bianchi | 256/13.1 |
| 3,416,484 | 12/1968 | Chapman | 404/10 X |
| 3,521,862 | 7/1970 | Cartner | 256/13.1 |
| 3,602,109 | 8/1971 | Harrington | 256/13.1 |

FOREIGN PATENT DOCUMENTS

| | | | |
|---|---|---|---|
| 570754 | 9/1958 | Belgium | 256/13.1 |
| 728977 | 12/1966 | Italy | 256/13.1 |

*Primary Examiner*—Andrew V. Kundrat
*Attorney, Agent, or Firm*—John K. Conant

[57] ABSTRACT

A guard barrier system for along the edge of a vehicular roadway or the like consists of substantially solid, resilient, generally cylindrical bumper elements axially mounted on posts for rotation thereon. A plurality of the posts with bumper elements thereon are spaced along the edge of a roadway or the like and are fixed to the ground in generally vertical position. Adjacent posts with bumper elements thereon are connected together to form a continuous barrier system by one or more cables or rails carried on the posts and extending between adjacent posts.

6 Claims, 4 Drawing Figures

GUARD BARRIER SYSTEM

BRIEF SUMMARY OF THE INVENTION

The present invention is an improved guard barrier system for use along the edges of vehicular roadways, automobile or horse racetracks, aircraft landing fields and the like.

It consists essentially of generally cylindrical, solid, resilient bumper elements rotatably carried on generally vertical posts that are fixed to the ground, as by having their lower ends embedded in the ground. A line of posts with bumper elements thereon are spaced apart, preferably less than the length of an average vehicle, along a roadway or the like and are connected by stringer elements, such as a cable or railing supported on and between adjacent posts.

The bumper elements are suitably made of used automobile or truck tires that are ground up into small particles or chunks and molded with the use of adhesive, or by application of heat, into the desired, generally cylindrical, shape with an axial bore therethrough for mounting them rotatabley on posts.

A particular object of this invention is to provide a guard barrier system that will bring a vehicle striking it to a halt, and do so in a manner such that the force of the impact will be absorbed and dissipated with minimum damage to the vehicle and without damaging or rendering inoperable the barrier system itself. The system of this invention is thus adapted to avoid the dangerous and economic disadvantages of conventional guard rail systems, which are relatively rigid and unyielding. When a conventional guard rail system is struck by a vehicle and the impact is relatively light, the vehicle invariabley suffers considerable damage due to the rigidity of the system. If the impact is heavy, the damage to the vehicle, and to the occupants, is correspondingly heavy; additionally the guard rail system is itself generally damaged so that it is no longer useful, is an eyesore, and frequently has broken ends projecting which are more dangerous to a subsequent vehicle, and to the vehicle's occupants, than no guard rail at all. In contradistinction the barrier system of the present invention by more effectively absorbing and dissipating impact forces, minimizes damage to impacting vehicles and itself remains intact, thereby reducing vehicle repair costs, personal injuries and the necessity for rebuilding the guard system after each accident.

PRIOR ART STATEMENT

The closest prior art of which applicant is aware is U.S. Pat. No. 4,062,521, issued Dec. 13, 1977. This patent discloses a barrier system formed by modules or blocks of a material adapted to burst apart an impact. The modules or blocks are connected in a line by a linear element, such as a cable, passing through a sequence of the spaced apart modules or blocks. The modules or blocks may be made of used tires, ground up and combined with an adhesive and molded to the desired shape.

The modules or blocks are free to slide along the ground except to the extent they are restrained by the cable connecting them in a line. On impact by a vehicle it is contemplated that the cable will stretch and the modules will slide along the ground until the tension of the cable acting on the interior of a module causes the module to burst, whereby the shock of the impact is absorbed by the combination of cable stretching, sliding of the module and the subsequent bursting of the module.

In contrast, in the barrier system of the present invention the bumper elements are in fixed position except that they are rotatable on the posts on which they are mounted. These bumper elements are solid but resilient and are made to absorb impact without bursting or breaking.

Other prior art patents, which are considerably less close than the prior art patent discussed above are:

U.S. Pat. No. 3,848,853.

U.S. Pat. No. 4,030,706.

DETAILED DESCRIPTION

Figure 1:
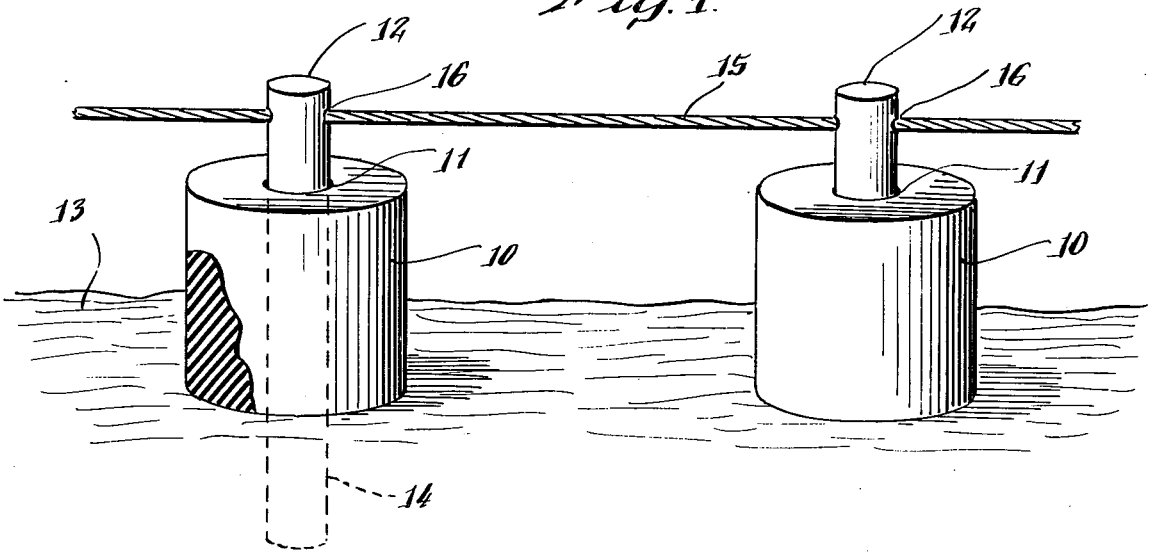
FIG. 1 is a perspective view of a portion of a guard barrier system in accordance with the present invention.

A guard barrier system of this invention as illustrated in FIG. 1 is formed by generally cylindrical, solid, resilient bumper elements 10 mounted on posts 12 by an axial bore 11 in each bumper element through which a post 12 is received. The posts 12, which are suitably steel, are fixed to the ground 13 in generally vertical position at spaced intervals along a roadway or the like. The posts 12 may be fixed to the ground by having their lower end portions embedded in the ground, as indicated at 14, and are connected into a continuous barrier system by a stringer element, such as a steel cable 15, supported on and extending between adjacent posts 12. In the FIG. 1 embodiment the cable 15 passes through holes 16 that are through the top portions of the posts 12 so that the cable is above the bumper element on each post.

The bores 11 of the bumper elements 10 through which the posts 12 are received are slightly larger than the diameter of the posts 12 so that the bumper elements are free to be rotated on the posts.

In the embodiments shown the bottom ends of the bumper elements rest on the ground so that rotation of a bumper element, such as caused by a vehicle striking the bumper element obliquely or tangentially, is resisted to an extent by the frictional contact with the ground which thereby assists the absorption and dissipation of the force of the impact.

The posts 12 with bumper elements 10 thereon are preferably spaced apart less than the length of an average vehicle expected to use the adjacent roadway. The posts in most cases would be spaced apart six to ten feet, for example. Most impacts which the barrier system will receive will be from vehicles striking it at an oblique angle to it. Consequently, a vehicle striking the system will strike at least one of the bumper elements, and the resilience of the bumper elements in combination with their ability to be rotated against some frictional resistance thus maximizes the extent to which each bumper element, or a sequence of the bumper elements, will absorb and dissipate impact force, and minimizes the possibility of damage to the system itself from the impact.

A vehicle striking the barrier system with great force will normally slide along into contact with a number of successive bumper elements in line. Each bumper element will absorb and dissipate some of the momentum force of the moving vehicle until the vehicle comes to rest by reason of the force of its motion being totally absorbed and dissipated by the resilience and frictionally resisted rotation of successive bumper elements.

In a preferred form the bumper elements 10 are made of used automobile or truck tires that have been ground up or shredded, mixed with an adhesive and molded into the desired size and shape. An alternative is to combine relatively finely ground up or comminuted used tire material with larger chunks of tire material formed by shredding the tires into chunks or short strips; this mixture is then mixed with an adhesive and molded to shape. The ground up and/or shredded tire material may also be molded to shape without an adhesive by applying sufficient heat and pressure to cause the particles of tire material to become tacky and adhere together into the desired mass.

Figure 2:
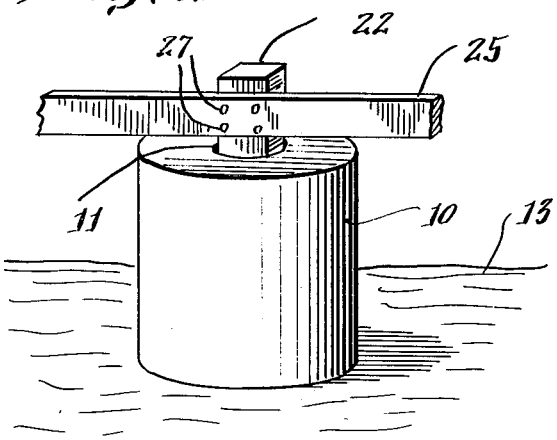
FIG. 2 and FIG. 3 are perspective views, respectively, of alternative embodiments of guard barrier systems of this invention.

In another embodiment of the invention illustrated in FIG. 2 the post 22, on which a bumper element 10 is mounted, is square in cross section while the bore 11 of the bumper element is round. This adds further resistance to rotation of the bumper element to enhance the absorption and dissipation of impact. This embodiment also illustrates an alternative form of stringer element, which in this embodiment is a rail 25, suitably steel, bolted to post 22 by bolts indicated at 27, and extending between adjacent posts.

Figure 3:
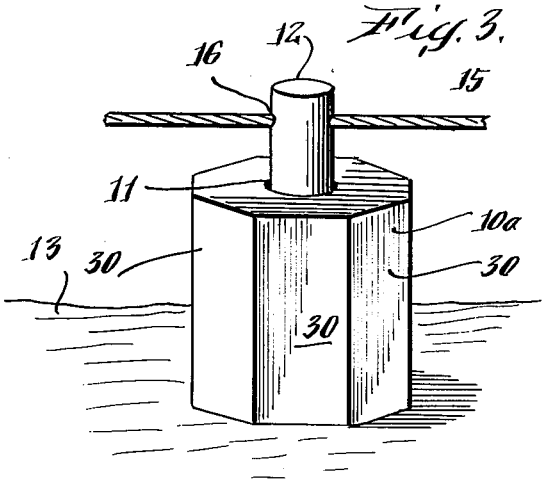

FIG. 3 shows an alternative form of bumper element 10*a*, which is octagonal in cross section, so as to present flat side surfaces 30, rather than a smooth curved side as on the bumper element 10 in FIGS. 1 and 2. These flat side surfaces 30 tend to retard the progress of an impacting vehicle sliding against the bumper element and thereby reduces the distance an impacting vehicle will slide along a sequence of adjacent bumper elements before its momentum is absorbed and dissipated by the bumper elements so as to bring the vehicle to a stop.

Figure 4:
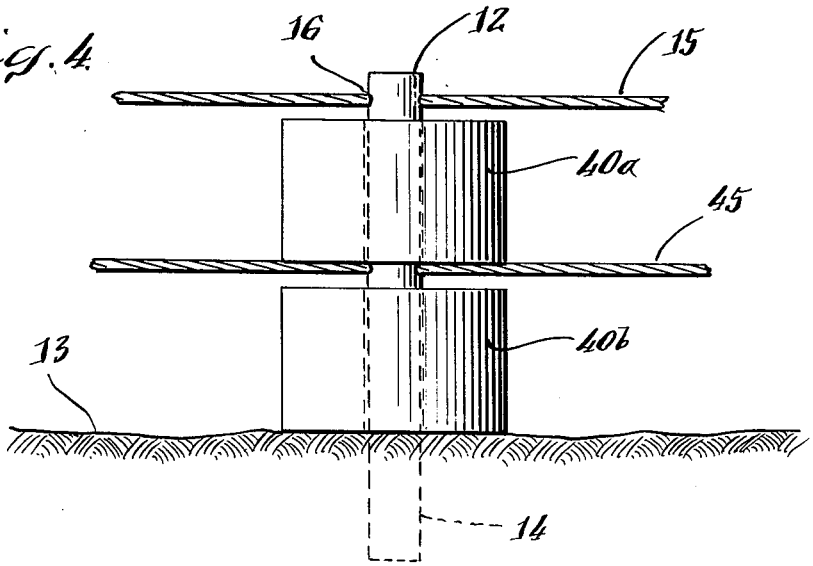
FIG. 4 is a side elevation of still another embodiment.

FIG. 4 illustrates another embodiment having a bumper element in two sections, 40*a* and 40*b*, on each post 12, and a second stringer element, a cable 45, threaded through the posts between the two bumper sections. The upper bumper element section 40*a* rests on the second stringer cable 45; the lower section 40*b* rests on the ground.

As indicated by the several embodiments illustrated, various configurations of posts and bumper elements, and various types of stringer elements are possible within the scope of the invention.

In practice the guard barrier system of this invention may conveniently be used in combination with a conventional guard rail system as a section thereof. For example, sections of this guard barrier system may be used advantageously in place of conventional systems along sections of highway where out-of control vehicles are most likely to strike a guard rail, specifically at curves and intersections. Also the bumper elements of the present system could be painted or colored with appropriate code colors, such as fluorescent orange, yellow or red, or black and white stripes, to indicate danger, or as a cautionary warning signal.

What is claimed is:

1. A guard barrier system comprising in combination a plurality of posts adapted to be spaced along a roadway or the like in generally vertical position with their lower ends fixed to the ground, a generally cylindrical, substantially solid, resilient bumper element mounted axially on each post for rotation thereon by the posts extending through longitudinal axial bores through the bumper elements, respectively, the bottom ends of said bumper elements resting on the ground to be in frictional engagement therewith for providing drag on rotation of the bumper elements, and a stringer element extending between each adjacent pair of posts supported on said posts said stringer element comprising one of a cable threaded through adjacent posts and a rail attached to successive posts, above the bumper elements thereon.

2. The guard barrier system of claim 1 in which one of said axial bore through a said bumper element and said post therethrough is round and the other is square in cross section.

3. The Guard barrier system of claim 1 in which said bumper element is substantially round in cross section.

4. The guard barrier system of claim 1 in which said bumper element has a sequence of flat surfaces thereon.

5. The barrier system of claim 1 which includes a second bumper element on said post, one of said bumper elements being above the other on said post, and a second stringer element between said two bumper elements, the bottom of the upper bumper element resting on said second stringer element.

6. The barrier system of claim 5 in which the bottom of the lower one of said bumper elements rests on the ground.

* * * * *